United States Patent [19]

Boulanger

[11] Patent Number: 4,710,143

[45] Date of Patent: Dec. 1, 1987

[54] PADDLE-DRIVEN WATERCRAFT

[76] Inventor: Paul Boulanger, rue Vinave 131, Grivegnee-Liege, Belgium

[21] Appl. No.: 21,542

[22] Filed: Feb. 27, 1987

Related U.S. Application Data

[63] Continuation of Ser. No. 761,570, Aug. 1, 1985, abandoned.

[30] Foreign Application Priority Data

Aug. 3, 1984 [BE] Belgium ..... 6/47990

[51] Int. Cl.[4] ..... A63C 15/00

[52] U.S. Cl. ..... 441/65; 114/363

[58] Field of Search ..... 441/65, 72, 74; 114/347, 363

[56] References Cited

U.S. PATENT DOCUMENTS 3,082,443 3/1963 Kimura ..... 441/65

3,289,227 12/1966 Kelly, Jr. ..... 441/74

FOREIGN PATENT DOCUMENTS 2460251 2/1981 France ..... 114/347

2525482 10/1983 France ..... 114/347

*Primary Examiner*—Joseph F. Peters, Jr.

*Assistant Examiner*—Jesûs D. Sotelo

*Attorney, Agent, or Firm*—Karl F. Ross; Herbert Dubno

[57] ABSTRACT

A paddle-driven watercraft formed as a single closed shell with a hull and deck. The seat-forming recess is bounded toward the rear by a rim and a central rise or prominence extends forwardly and upwardly to a level above the rise in the deck to define a pair of platforms forwardly of the seat on which the user can kneel, and at the forward ends of these platforms with respective footrests. The platforms are laterally unconfined outwardly so that the seat platforms and footrests prevent accumulation of water.

2 Claims, 2 Drawing Figures

PADDLE-DRIVEN WATERCRAFT

This is a continuation of co-pending application Ser. No. 761,570 filed on Aug. 1, 1985, now abandoned.

FIELD OF THE INVENTION

The present invention relates to a watercraft which may be used as a leisure or competition craft on a river, on a lake or along the coast and which is driven by muscular strength acting on a paddle.

BACKGROUND OF THE INVENTION

Paddle watercraft such as a kayak have the disadvantage of having a seat for the paddler which often fills up with water, in particular when such crafts capsize, and in which the paddler may remain trapped if the craft collides with a rock or a tree.

OBJECT OF THE INVENTION

The object of the invention is to eliminate this drawback and provide a paddle-driven watercraft accessible to everybody.

SUMMARY OF THE INVENTION

According to the invention, a watercraft is provided which comprises a single closed or self-contained shell which forms a hull and a deck, the latter being shaped with at least one hollow part intended to be used as a seat, preceded by a prominent or projecting section forming on either side of the deck a footboard and at least a footrest, so shaped as to allow water to run-off the craft easily, thus preventing water from accumulating as in a bowl-shaped structure.

In accordance with the invention, the craft further features a hull with an inverse or negative keel.

BRIEF DESCRIPTION OF THE DRAWING

The invention will now be described with reference to the attached drawing, in which.

SPECIFIC DESCRIPTION

Figure 2:
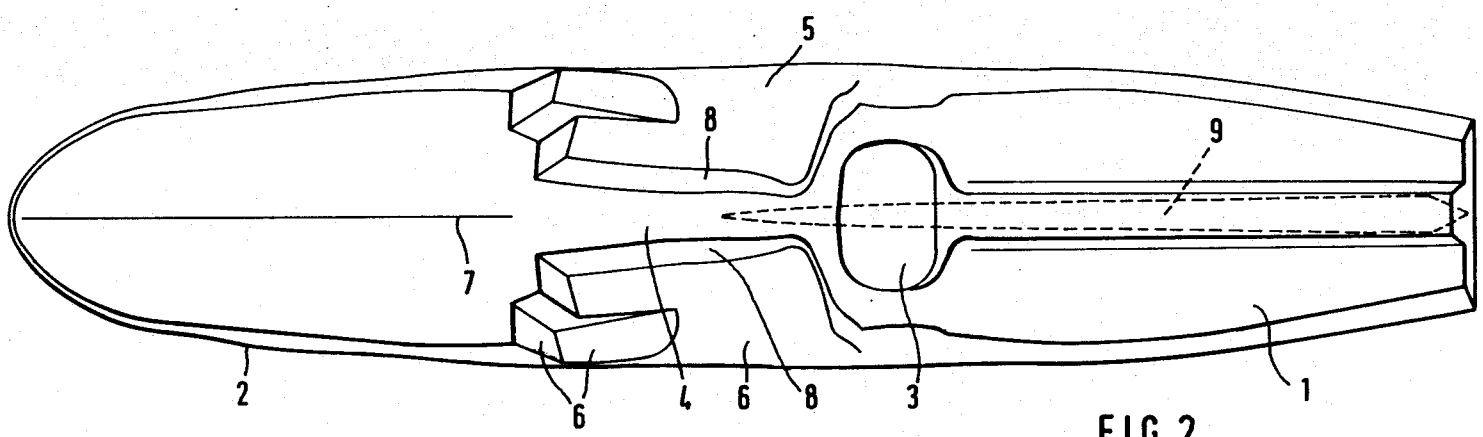
FIG. 2 is a top plan view of the same.
Figure 1:
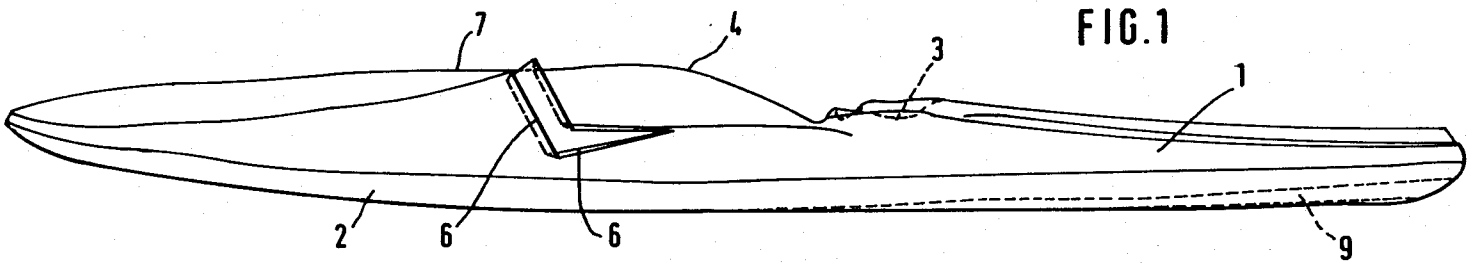
FIG. 1 is a side elevation of a paddle-driven watercraft in accordance with the invention.

The watercraft or paddle-driven board illustrated consists of a single closed or self-contained shell which comprises a hull 2 and a deck 1. The latter features a hollow part 3 intended to be used as a seat by the paddler, which is slightly off-set towards the fore-part of the craft and preceded by a prominent section 4. As extra hollow part 3 may be provided for a passenger or for a second paddler.

The deck is formed with: p1 a seat-forming recess bounded toward the stern by a raised rim and open forwardly toward said bow,

- a central dip immediately ahead of said seat-forming recess in the direction of said bow,
- a central rise convexly curved upwardly from said dip forwardly to a level above said rim,
- a forwardly and downwardly inclined slope from said rise to said bow,
- a pair of laterally unconfined platforms upon which a user of the watercraft can kneel on opposite sides of said rise.

The prominent section 4 of the deck 1 is so shaped as to create a footboard or platform 5 and a footrest 6 on either side of the craft.

The prominent section or rise 4 of the deck 1 is designed with rough surfaces meant to offer adherence these rough surfaces are provided at summit 7 so that a passenger may be seated thereon and along sides 8 so that the craft may be easily held and carried.

The underside of the shell or hull 2 is ahsped with an inverse or negative keel 9 to prevent the craft from side-slipping. This adverse or negative keel may widen out and convert the single hull into a doube hull so that the stability of the craft is increased.

A watercraft in accordance with the invention may advantageously be 2 m to 4.50 m long and 0.5 m to 1 m wide.

The present craft is so streamlined as to guide on or plough through water; the paddler may be kneeling on the footboards 5 or sitting in the hollow part 3 with his feet on the footrests 6, so as to steer and control the watercraft. It is possible to provide the craft with straps intended to secure the paddler's feet and pelvis in case of stormy weather or high water.

Such craft may be used as a sports and competition craft, as a leisure craft as a pedal craft or water bicycle, but also for transporting objects or goods in swampy or marshy regions.

I claim:

1. A paddle-driven watercraft comprising a single elongated closed shell formed with a hull constituting an underside of said shell and a deck constituting an upper surface of said shell, said shell defining a bow at a front end thereof, said hull and said deck being elongated in a direction of travel of said watercraft, said hull being formed with:

- a downwardly open, rearwardly widening channel terminating at a stern of said shell and commencing at a location substantially midway of the length of said shell, and
- said channel subdividing said hull between said location and said stern into two rearwardy extending hull sections separated by said channel,
- said deck being formed with:
  - a seat-forming recess bounded toward the stern by a raised rim and open forwardly toward said bow,
  - a central dip immediately ahead of said seat-forming recess in the direction of said bow, p2 a central rise convexly curved upwardly from said dip forwardly to a level above said rim,
  - a forwardly and downwardly inclined slope from said rise to said bow,
  - a pair of laterally unconfined platforms upon which a user of the watercraft can kneel on opposite sides of said rise, and
  - a respective upwardly and forwardly inclined footrest at an end of each of said platforms proximal to said bow, said footrests being formed on opposite sides of said central rise, said seat-forming recess, said platforms and said footrests being constructed and arranged to preclude collection of water on said deck.

2. The paddle-driven watercraft defined in claim 1 wherein said central rise is formed with a roughened surface on its upper and lateral surfaces.

* * * * *